US006697594B1

(12) United States Patent
Murphy et al.

(10) Patent No.: US 6,697,594 B1
(45) Date of Patent: Feb. 24, 2004

(54) DOCTOR BLADE SUPPORT FOR AN IMAGE FORMING APPARATUS

(75) Inventors: Calvin D. Murphy, Lexington, KY (US); Jarrett C. Gayne, Lexington, KY (US); Jason Hale, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/243,809

(22) Filed: Sep. 13, 2002

(51) Int. Cl.[7] ..... G03G 15/08
(52) U.S. Cl. ..... 399/284
(58) Field of Search ..... 399/102, 103, 399/105, 274, 284

(56) References Cited

U.S. PATENT DOCUMENTS

| | | | | |
|---|---|---|---|---|
| 3,829,927 | A | | 8/1974 | Boyland |
| 4,135,197 | A | | 1/1979 | Stoneburner |
| 4,266,868 | A | | 5/1981 | Bresina et al. |
| 4,372,203 | A | | 2/1983 | Brasa |
| 4,387,118 | A | | 6/1983 | Shelton |
| 4,453,463 | A | | 6/1984 | Dahlgren et al. |
| 4,566,776 | A | * | 1/1986 | Kondoh ..... 399/274 |
| 5,085,171 | A | | 2/1992 | Aulick et al. |
| 5,233,390 | A | | 8/1993 | Fujimoto |
| 5,303,010 | A | | 4/1994 | Takano et al. |
| 5,417,761 | A | | 5/1995 | Bernert |
| 5,470,635 | A | | 11/1995 | Shirai et al. |
| 5,524,540 | A | | 6/1996 | Van Denend |
| 5,565,961 | A | | 10/1996 | Shoji et al. |
| 5,608,509 | A | | 3/1997 | Shirai et al. ..... 399/351 |
| 5,623,718 | A | | 4/1997 | Bracken et al. ..... 399/284 |
| 5,642,187 | A | | 6/1997 | Nomura et al. ..... 399/111 |
| 5,678,139 | A | | 10/1997 | Nomura et al. ..... 399/114 |
| 5,697,021 | A | | 12/1997 | Watanabe et al. ..... 399/102 |
| 5,702,812 | A | | 12/1997 | Bracken et al. |
| 5,749,026 | A | | 5/1998 | Goldie ..... 399/103 |
| 5,768,670 | A | | 6/1998 | Enomoto et al. ..... 399/284 |
| 5,797,076 | A | | 8/1998 | Bracken et al. ..... 399/284 |
| 5,812,918 | A | | 9/1998 | Nakaue et al. ..... 399/284 |
| 5,853,868 | A | | 12/1998 | Bracken et al. |
| 5,867,751 | A | | 2/1999 | Nomura et al. ..... 399/90 |
| 5,920,754 | A | | 7/1999 | Chung et al. ..... 399/119 |
| 5,933,692 | A | | 8/1999 | Niwano et al. ..... 399/284 |
| 6,021,297 | A | | 2/2000 | Campbell et al. ..... 399/284 |
| 6,035,781 | A | | 3/2000 | Rogge et al. |
| 6,078,770 | A | | 6/2000 | Watabe et al. ..... 399/284 |
| 6,078,771 | A | * | 6/2000 | Buchanan et al. ..... 399/284 |
| 6,263,180 | B1 | | 7/2001 | VanLaeken et al. ..... 399/284 |
| 6,272,300 | B1 | | 8/2001 | Fujiwara et al. ..... 399/113 |

* cited by examiner

*Primary Examiner*—William J. Royer
(74) *Attorney, Agent, or Firm*—John A. Brady

(57) ABSTRACT

A device and method of supporting a doctor blade within an image forming apparatus. The device has a housing for positioning a doctor blade such that a bottom edge contacts a developer roller. One or more extensions are positioned to support a first side of the doctor blade. The one or more extensions may include dampeners which are constructed of a resilient material. Supports are positioned on a second side of the doctor blade. The doctor blade is sized to fit between the one or more extensions and the supports. A method of supporting the doctor blade includes positioning the doctor blade to dampen vibrations and velocity fluctuations caused by sticking and slipping of the bottom edge of the doctor blade against the developer roller.

19 Claims, 6 Drawing Sheets

DOCTOR BLADE SUPPORT FOR AN IMAGE FORMING APPARATUS

Background

Image forming devices including copiers, laser printers, facsimile machines, and the like, include a drum having a rigid cylindrical surface that is coated along a defined length of its outer surface with a photoconductive material. The surface of the drum is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is brought into contact with the photoconductive surface. The drum then rotates past an intermediate transfer medium where the toner is transferred onto the medium. A recording sheet, such as a blank sheet of paper, is then brought into contact with the intermediate transfer medium and the toner thereon is transferred to the recording sheet in the form of the latent electrostatic image. The recording sheet is then heated thereby permanently fusing the toner to it. In preparation for the next image forming cycle, the photoconductive surface is discharged and residual toner is removed.

The toner is stored in a toner reservoir adjacent to the drum. A doctor blade and developer roller are positioned between the toner reservoir and drum for controlling the amount of toner passed to the drum. A point created between the doctor blade and the developer roller controls the amount of toner transferred to the drum. It is important that the doctor blade make uniform and consistent contact across the entire length of the developer roller. If the doctor blade has inconsistent pressure with the developer roller during the transfer, uneven toner amounts will be transferred to the drum resulting in inconsistent and unacceptable print quality. If too much toner is transferred to the drum, printing errors may occur such as blurred images, poor color, and toner particles deposited on the background areas. Conversely, if not enough toner is transferred to the drum, the images will be too light and difficult to see.

A problem in maintaining consistent contact and pressure is the developer roller profile may be non-uniform requiring that the doctor blade move inward and outward to track the surface of the developer roller. Additionally, it is vital that contact be maintained across the entire length of the doctor blade to ensure even print quality across the width of the image.

One problem in prior systems is jitter caused by vibrations and velocity fluctuations in the developer roller during the printing process. Jitter shows up on a printed page as a repeating pattern of light and dark lines in the process direction that extend across the printed image. One cause of jitter is the doctor blade sticking to and slipping across the surface of the developer roller. The stick/slip movement causes the doctor blade to move back and forth which results in small perturbations on the developer roller which translate into small velocity variations.

One proposed solution is to lessen the amount of force that the doctor blade exerts on the developer roller. However, the amount of force applied by the doctor blade controls the amount of toner transferred to the developer roller. If the force is decreased to prevent or decrease jitter, toner transfer may be adversely affected. Also, it has been determined that lesser biasing force may prevent the doctor blade from sticking and skipping along the developer roller, but may not prevent vibrations that result in jitter. Further, another cause of jitter may be the electrical force between the developer roller and the drum. Lessening the amount of biasing force does not substantially reduce or eliminate this cause of jitter.

SUMMARY

The present invention includes an apparatus and method of dampening a doctor blade within an image forming apparatus. In one embodiment, the apparatus includes a developer housing having an area for housing the doctor blade, a biasing member to bias the doctor blade against a developer roller, a member connected to a developer housing on a first side of the doctor blade, an extension connected to the developer housing and positioned on a second side of the doctor blade opposite the member on the first side, and a dampener attached to the extension and positioned between the extension and the doctor blade. In this embodiment, the dampener is constructed of a resilient material to dampen the movement of the doctor blade.

In another embodiment, the apparatus includes a developer housing having a first edge and a second edge positioned a distance apart for positioning a doctor blade, and a support extending between the first edge and the second edge. A first extension and a second extension each extend from the support and are equally distanced from a centerline of the developer housing.

In another embodiment, the apparatus is incorporated within an image forming apparatus which includes a developer roller, a doctor blade having a top edge and a bottom edge that contacts the developer roller, a biasing member that contacts the top edge of the doctor blade and biases the doctor blade against the developer roller, members positioned to contact a front side of the doctor blade, extensions positioned on a back side of the doctor blade, and dampeners positioned on the first extension. In this embodiment, the front side of the doctor blade contacts the members and the back side of the doctor blade contacts the dampeners.

The invention further includes a method of dampening a doctor blade by placing a dampening material against the doctor blade to dampen movement caused by sticking and slipping of a bottom edge of the doctor blade against the surface of a developer roller.

DETAILED DESCRIPTION

Figure 1:
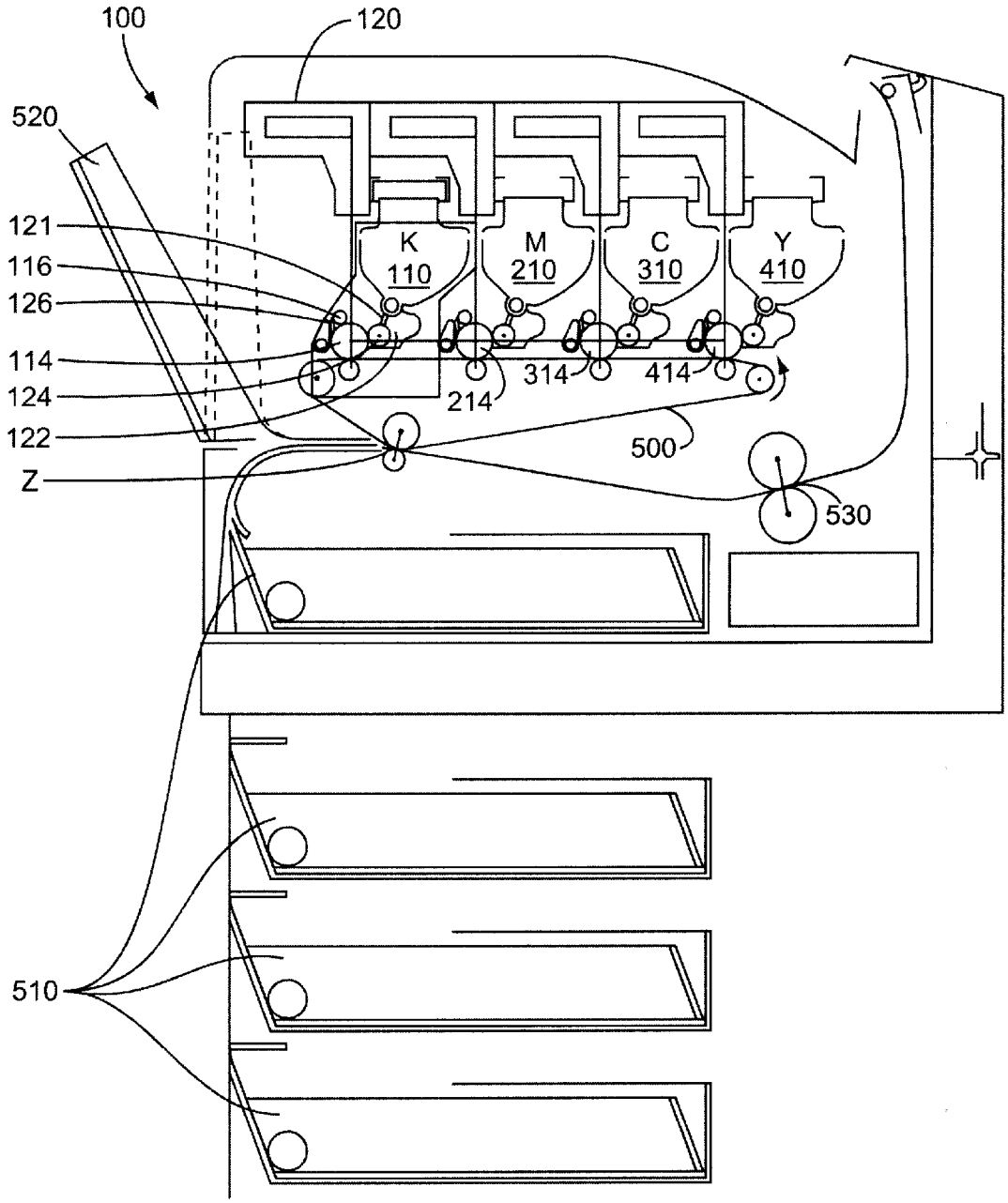
FIG. 1 is a front view illustrating an image forming apparatus constructed according to one embodiment of the present invention.

FIG. 1 illustrates the basic elements of an image forming apparatus and is incorporated for an understanding of the overall electrophotogr process. A four cartridge c color laser printer is illustrated as 100, however on e skilled in the art will understand that the present invention is applicable to other types of image forming devices using toner for printing with a photoconductor. The printer, image forming apparatus or image forming device, generally designated 100, includes a plurality of similar toner cartridges 110, 210, 310, and 410. Each toner cartridge 110, 210, 310 and 410 i s of a similar construction but is distinguished by the toner color contained therein. In the preferred embodiment, the device 100 includes a black (K) cartridge 110, a magenta (M) cartridge 210, a cyan (C) cartridge 310, and a yellow (Y) cartridge 410. Each different color toner forms an individual image of a single color that is combined in layered fashion to create the final multi- colored image.

Each of the toner cartridges 110, 210, 310 and 410 is substantially identical and includes a photoconductor, a developer device, and a cleaning device. As the toner cartridges 110, 210, 310 and 410 are identical except for the toner color, the toner cartridge 110 and elements for forming black images will be described, with the other color image forming units being omitted for simplification.

A photoconductor 114 is generally cylindrically-shaped with at least one end that intermeshes with the image forming device drive gears to provide for a rotational force. The photoconductor 114 has a smooth surface for receiving an electrostatic charge over the surface as the photoconductor 114 rotates past charging device 116. The photoconductor 114 uniformly rotates past a scanning laser 120 directed onto a selective portion of the photoconductor 114 surface forming an electrostatically latent image across the width of the photoconductor representative of the outputted image. The drive gears rotate the photoconductor 114 continuously so as to advance the photoconductor 114 about $1/600^{th}$ or $1/1200^{th}$ of an inch between laser scans. This process continues as the entire image pattern is formed on the photoconductor surface.

After receiving the latent image, the photoconductor 114 rotates to a developer which has a toner bin, illustrated generally as 122 in FIG. 1, for housing the toner and a developer roller 124 for uniformly transferring toner to the 114 photoconductor. The toner is transferred from the toner bin 122 to the photoconductor 114 through a doctor blade nip formed between the developer roller 124 and a doctor blade 121. The toner is a fine powder usually constructed of plastic granules that are attracted and cling to the areas of the photoconductor 114 that have been discharged by the scanning laser 120.

The photoconductor 114 next rotates past an adjacently-positioned intermediate transfer mechanism belt 500 (hereinafter, ITM belt) to which the toner is transferred from the photoconductor 114. As illustrated in FIG. 1, the ITM belt 500 is endless and extends around a series of rollers adjacent to photoconductors 114, 214, 314 and 414. The ITM belt 500 and each photoconductor 114, 214, 314, 414 are synchronized providing for the toner from each photoconductor 114, 214, 314 and 414 to precisely align on the ITM belt 500 during a single pass. By way of example as viewed in FIG. 1, the yellow toner will be placed on the ITM belt 500, followed by cyan, magenta, and black.

After depositing the toner on the ITM belt 500, the photoconductor 114 rotates through a cleaning area where residual toner is removed from the surface via a brush or scraper 126. The residual toner is moved along the length of the photoconductor 114 to a waste toner reservoir. In one embodiment, the photoconductor 114 further passes through a discharge area (not shown) having a lamp or other light source for exposing the entire photoconductor surface to light to remove any residual charge and image pattern formed by the scanning laser 120

As the photoconductors 114, 214, 314 and 414 are being charged and gathering toner, a recording sheet, such as a blank sheet of paper, is being routed to intercept the ITM belt 500. The paper may be placed in one of the trays 510, or introduced into the image forming device through a side track tray 520. A series of rollers and belts transport the paper to point Z where the sheet contacts the ITM belt 500 and receives the toner. The sheet may receive an electrostatic charge prior to contact with the ITM belt 500 to assist in attracting the toner from the ITM belt 500. The sheet and attached toner next travel through a fusser 530 having a pair of rollers and a heating element that heats and fuses the toner to the sheet. The paper with fused image is then transported out of the printer 100 for receipt by a user.

Figure 2:
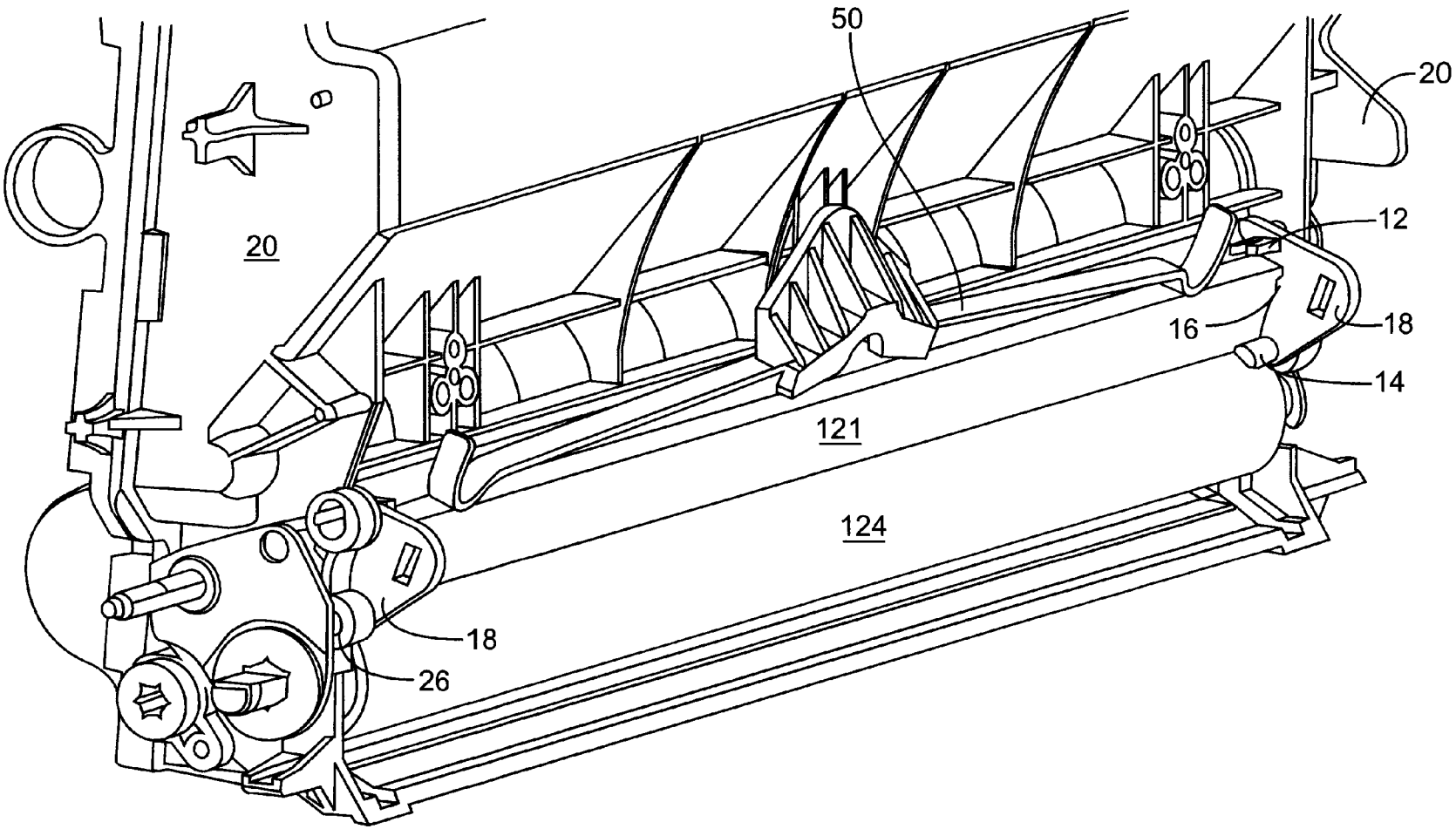
FIG. 2 is a perspective view of a developer housing having a doctor blade and developer roller according to one embodiment of the present invention.

FIG. 2 illustrates one embodiment of a developer housing 20 with the doctor blade 121 positioned against the developer roller 124. In one embodiment, the structure adjacent to the first and second ends of the doctor blade 121 maintains the position relative to the developer roller 124. Stop posts 12 extend over the doctor blade 121 and are each positioned within an aperture 26 in the developer housing 20. The stop post 12 is positioned above the doctor blade 121 opposite the developer roller 124 and functions to control the maximum movement of the doctor blade 121 away from the developer roller 124. The stop post 12 is especially effective for safety concerns during handling of the cartridge to keep the doctor blade 121 within the cartridge. By way of example, if the cartridge is dropped, the stop post 12 prevents the doctor blade 121 from separating from the developer housing 20 and possibly damaging the cartridge, image forming apparatus, or injuring a person handling this equipment.

Retention posts 14 are positioned at each end of the doctor blade 121 to control one aspect of lateral movement of the doctor blade 121 relative to the developer roller 124. A pair of retention blocks 16 extend from the developer housing 20 along the doctor blade 121 to further maintain the lateral position. As the developer roller 124 rotates in the direction of arrow 101 in FIG. 5, the doctor blade 121 is pushed against the retention post 14 and retention block 16. The retention post 14 and retention block 16 work in combination and the doctor blade 121 may contact one or both during the toner transfer process. The stop post 12, retention post 14, and retention block 16 are mounted to support each end of the doctor blade 121. The stop post 12, retention post 14, and retention block 16 may have a variety of shapes to effectively control the positioning of the doctor blade 121.

In one embodiment, the stop post 12, retention post 14, and retention block 16 are constructed as a unitary piece having a common back section 18. Preferably, the piece is constructed of a low friction material, and in one preferred embodiment the piece is constructed from acetal. The distance the stop post 12, retention post 14, and retention block 16 extend outward along the doctor blade 121 may vary.

A biasing member 50 attached to the developer housing 20 is positioned above the doctor blade 121 to maintain a continuous force for biasing the doctor blade 121 against the developer roller 124. The amount of force applied by the biasing member 50 also controls the amount of toner transferred to the developer roller 124. The drawings illustrate the doctor blade 121 substantially perpendicular to the developer roller 124, however, other orientations may also provide for transfer of proper toner amounts. The biasing member 50 may contact the doctor blade 121 at one or more locations along the length of the doctor blade 121 to ensure an even and distributed force is applied across the entire width of the developer roller 124. In one embodiment, the biasing member 50 provides about 1400 grams of force to the developer roller 124. U.S. pat. No. 6,078,771, assigned to the Lexmark International, Inc., the assignee of the present application, discloses various structure for an image forming apparatus and is incorporated by reference herein in its entirety.

Figure 3:
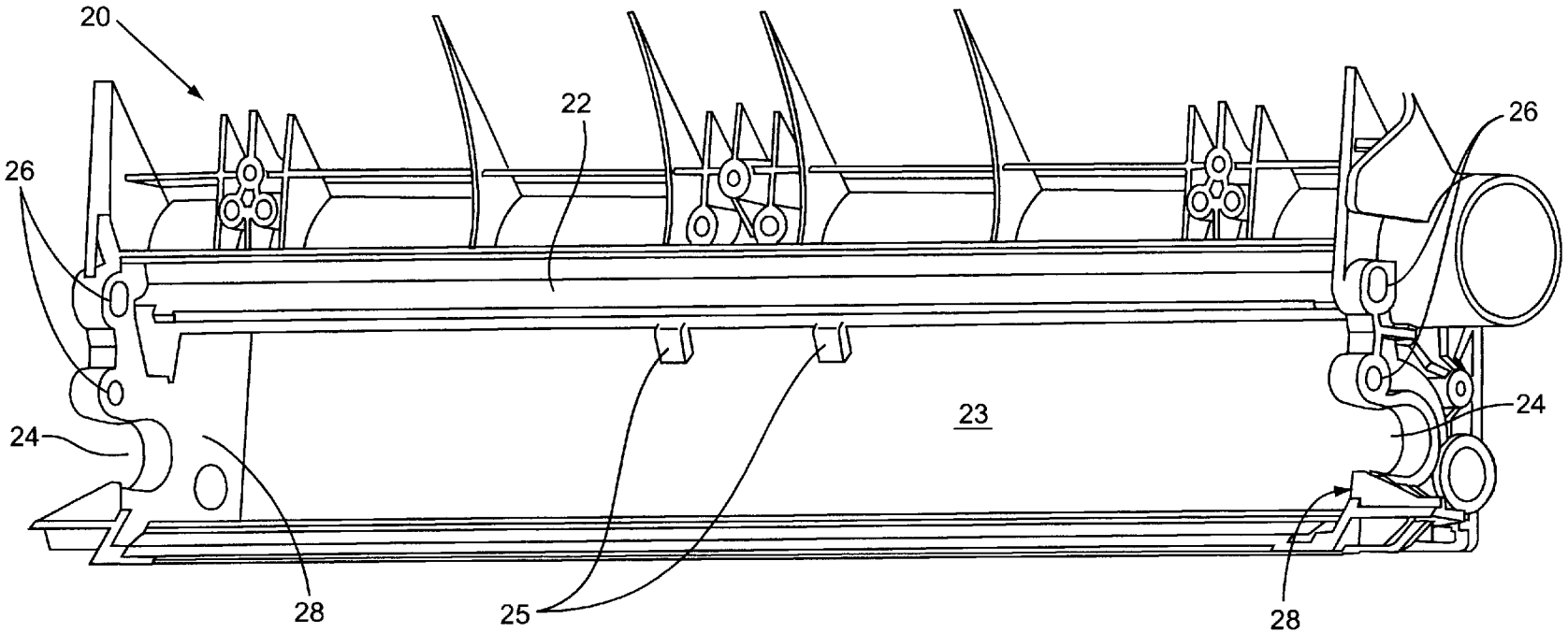
FIG. 3 is a partial perspective view illustrating a front side of the developer housing having two extensions according to one embodiment of the present invention.

FIG. 3 illustrates the developer housing 20 with the doctor blade 121 and developer roller 124 removed for clarity. The developer housing 20 contains the toner and provides a structure for mounting the doctor blade 121 and developer roller 124. In one embodiment, the developer housing 20 includes an area 23 for housing the doctor blade 121 that includes openings 24 through which developer roller axles extend for positioning the developer roller 124. A support 22 extends along at least a section of the area 23 and includes extensions 25 extending outward for supporting the doctor blade 121 as will be explained below. The developer housing 20 forms an inner sidewall 28 that provides for laterally maintaining the doctor blade 121 over the developer roller 124. In one embodiment, apertures 26 are positioned within the inner sidewalls 28. The developer housing 20 may be constructed of any rigid material for supporting the toner and doctor blade 121, and in one embodiment is constructed of polystyrene.

Figure 4:
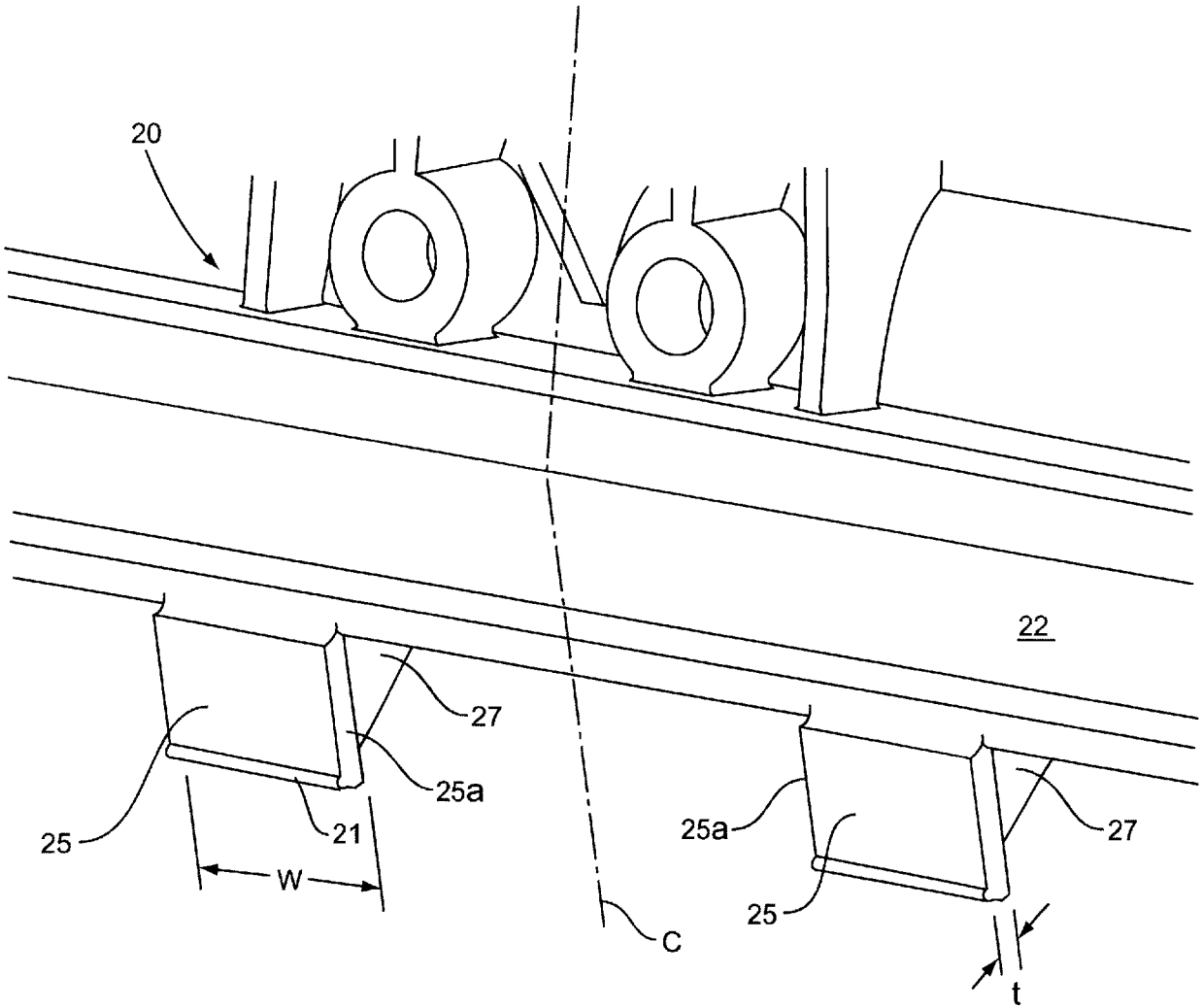
FIG. 4 is a partial perspective view illustrating the two extension illustrated in FIG. 3.
Figure 5:
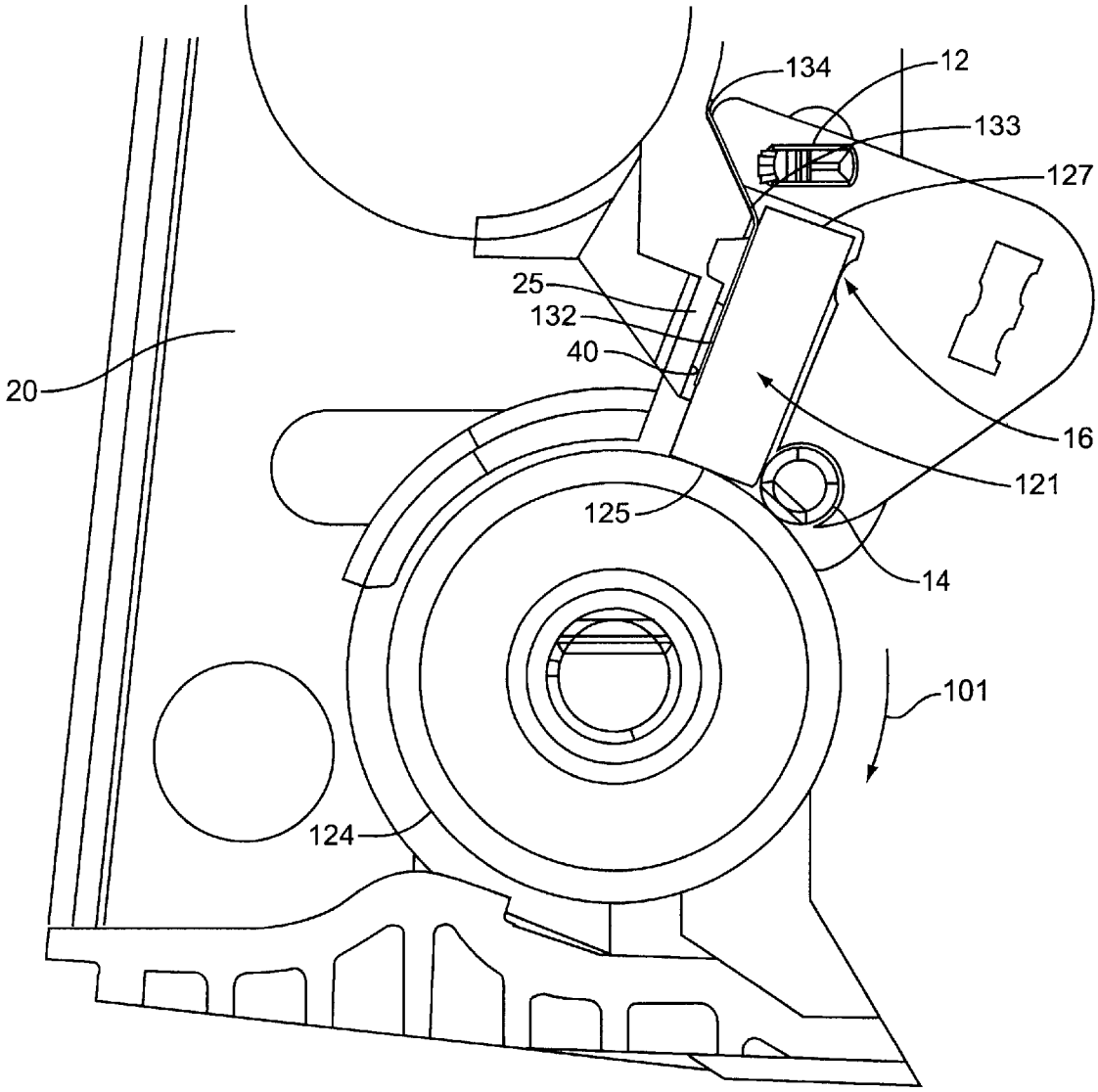
FIG. 5 is a side view illustrating the developer housing and extension relative to the doctor blade and developer roller according to one embodiment of the present invention.

FIG. 4 illustrates one embodiment having a pair of extensions 25 mounted on the support 22 of the developer housing 20. In this embodiment, the extensions 25 are equally spaced from a centerline C of the developer housing 20. The distance between the extensions 25 may vary depending upon the parameters of the printing device. In one embodiment, the inner edges 25*a* are separated by a total of about 25.02 mm (i.e., the inner edge 25*a* of each extension is about 12.51 from the centerline C). The extensions 25 may have a variety of shapes and sizes. In one embodiment, the extensions 25 are substantially rectangular in shape and have a width w of about 4.98 mm and a thickness t of about 1.50 mm. In one embodiment, a stiffening rib 27 extends between the developer housing 20 and a back of the extension 25 for additional stiffness and strength. In one embodiment, a shoulder 21 extends outward from the face of the extension 25 to support a dampener 40 (FIG. 5). In one embodiment, both extensions 25 have the same shape and size and dimensions to equally support the doctor blade 121.

In another embodiment, only one extension 25 extends from the developer housing 20 to support the doctor blade 121. In this embodiment, the extension 25 is centered about the centerline C. In another embodiment, more then two extensions 25 are mounted on the developer housing 20 to support the doctor blade 121. The extensions 25 are spaced about the support 22 to equally support the length of the doctor blade 121. The sizes and shapes of the extensions 25 may vary depending upon their position on the support 22, and the total number of extensions 25.

FIG. 5 illustrates a side view of one embodiment with the extension 25 having a dampener 40 mounted on the front side to contact the doctor blade 121. Dampener 40 has a damping capacity to absorb vibrations from the doctor blade 121. In one embodiment, dampener 40 is constructed of a resilient material that is compressed by the doctor blade 121 and thus applies a force to the doctor blade 121. In one embodiment, the dampener 40 is constructed of PORON foam, a polyurethane foam commercially available from Rogers Corp. as 4790-92-2008104. The dampener 40 has a thickness such that the doctor blade 121 contacts the dampener 40 on a first side and a retention block 16 on the opposite side. In one embodiment, dampener 40 is about 2.06 mm thick. Dampener 40 may have a variety of shapes and sizes. In one embodiment, dampener 40 extends beyond the extension 25, either on the lower edge, upper edge, or one or both side edges. In one embodiment, dampener 40 is positioned on the front of the extension 25 and rests on a shoulder 21 adjacent to a bottom edge of the extension 25. In one embodiment, dampener 40 has a uniform cross-section thickness with the front surface that contacts the doctor blade 121 being substantially parallel to the front surface of the extension 25. In one embodiment, dampener 40 has a width of about 4.98 mm.

In one embodiment, the distance between an inside edge of the front support and an inside edge of the extension 25 is less than a thickness of the doctor blade 121 and a thickness of the dampener 40. Therefore, the dampener 40 is maintained in a compressed state.

In one embodiment, dampener 40 is attached to the extension 25 by an adhesive that may be applied in a variety of manners. In one embodiment, the adhesive comprises a pressure sensitive material applied to one side of the dampener 40 facing the extension 25. In one embodiment, the adhesive is Model No. 7953 manufactured by 3M. Extension 25 may include a knurled surface to improve the adhesion of the adhesive.

In one embodiment as illustrated in FIG. 5, a flap seal 133 extends along the back side of the doctor blade 121. The flap seal 133 includes an upper edge 134 attached to the developer housing 20 to prevent toner from leaking across the top edge 127 of the doctor blade 121. A bottom edge 132 extends along the doctor blade 121 to prevent toner from leaking along the back edge of the doctor blade 121. The flap seal 133 is positioned against the back edge of the doctor blade 121. In one embodiment, the flap seal 133 is positioned between the doctor blade 121 and the dampener 40. In another embodiment, flap seal 133 is positioned between the extension 25 and the dampener 40. The flap seal 133 may extend beyond the length of both the dampener 40, beyond the length of the extension 25, or both. In one embodiment, flap seal 133 may extend a distance less than the length of either the dampener 40 or extension 25. The material of the flap seal 133 provides for a low to zero friction contact with doctor blade 121. In one embodiment, the flap seal 133 is constructed of mylar, however, other low friction materials may also be used. In one embodiment, flap seal 133 is not attached to the doctor blade 121.

Figure 6:
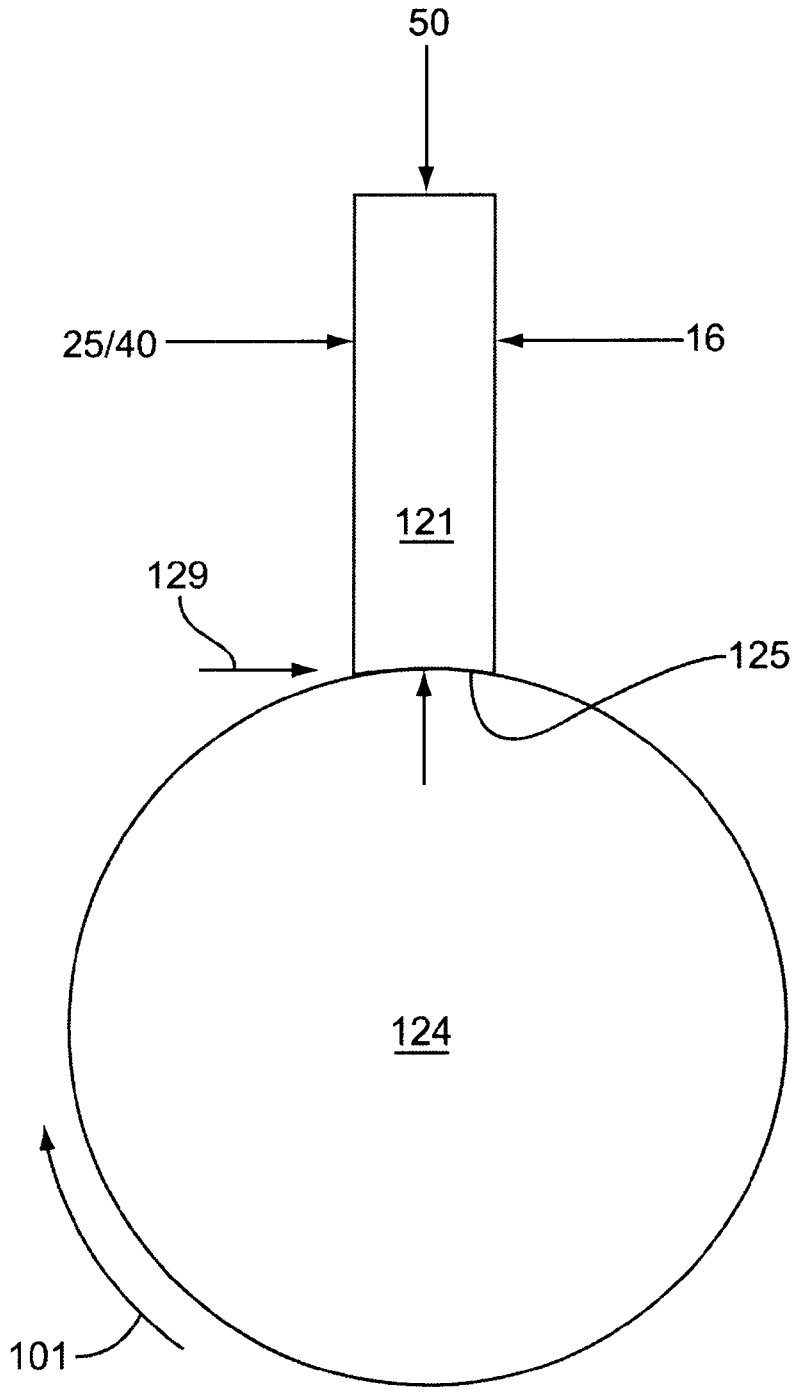
FIG. 6 is a schematic diagram illustrating the forces exerted on the doctor blade in accordance with one embodiment of the present invention.

FIG. 6 is a schematic diagram illustrating the forces acting on the doctor blade 121. Spring 50 applies a force that is countered by the force applied by the developer roller 124. Extension 25 and dampener 40 and the frictional force 129 of the doctor blade 121 contacting the developer roller 124 apply a force that is countered by the force of the retention block 16.

In one embodiment, the doctor blade 121 and the front surfaces of the extension 25 and dampener 40 are aligned substantially perpendicular to the surface of the developer roller 124. A force applied by the extension 25 and dampener 40 is in a direction tangent to the surface of the developer roller 124. The angle of the doctor blade 121 relative to the developer roller 124, and the angle of the dampener 40 and extensions 25 relative to the doctor blade 121 may vary. The extensions 25 and dampener 40 are positioned to provide a force on the doctor blade 121 in a direction tangent to the surface of the developer roller 124, or in a direction away from the surface of the developer roller 124.

In use, as the developer roller 124 rotates in the direction of arrow 101 illustrated in FIG. 5, toner from the toner bin 122 is transferred at the nip point between the lower edge 125 of the doctor blade 121 and the developer roller 124. The pressure of the doctor blade 121 against the developer roller 124 controls the mass flow and charge level of the toner. The biasing member 50 provides a predetermined force on the doctor blade 121 that is transferred to the nip point. Because of the non-uniform profile of the developer roller 124, the doctor blade 121 may move in and out. The doctor blade 121 may be positioned at a variety of angles relative to the developer roller 124. Any vibrations or variations in the relative position of the doctor blade 121 relative to the developer roller 124 are lessened or dampened by the dampener 40. Consistent positioning and consistent pressure provides for toner transfer through the nip formed between the doctor blade lower edge 125 and the developer roller 124 to be consistent and reduce or eliminate jitter. Without the dampening, vibrations result in variations in the pressure amounts within the nip, and variations in the spacing of the nip result in toner deviations that cause print defects.

The present invention may be carried out in other specific ways than those herein set forth without departing from the scope and essential characteristics of the invention. In one embodiment, one or all of the stop post 12, retention post 14, and retention block 16 are part of the developer housing 20 and are not separately mounted to the developer housing 20. In one embodiment, the front surface of the extension 25 is substantially flat to support the doctor blade 121 equally across the width of the extension 25. In another embodiment, the surface of the extensions 25 are knurled to assist in receiving the adhesive. In one embodiment, the extensions 25 do not include a dampener 40 as the extensions 25 alone provide a dampening force on the doctor blade 121. The present embodiments are, therefore, to be considered in all respects as illustrative and not restrictive, and all changes coming within the meaning and equivalency range of the appended claims are intended to be embraced therein.

What is claimed is:

1. A device to support a doctor blade relative to a developer roller within an image forming apparatus comprising:

a developer housing having an area for housing the doctor blade;

a biasing member to bias the doctor blade against the developer roller;

a member connected to the developer housing on a first side of the doctor blade;

an extension connected to the developer housing and positioned on a second side of the doctor blade opposite the member; and a dampener attached to the extension and positioned between the extension and the doctor blade, the dampener being constructed of a resilient material to dampen the movement of the doctor blade.

2. The device of claim 1, wherein the developer housing further comprises a first sidewall and a second sidewall to position a first end and a second end of the doctor blade.

3. The device of claim 1, wherein a distance between an inside edge of the extension and an inside edge of the member is less than a thickness of the doctor blade and a thickness of the dampener.

4. The device of claim 3, wherein the dampener is in a compressed state.

5. The device of claim 3, wherein the dampener is constructed of a material having a damping capacity.

6. The device of claim 1, wherein the extension further comprises a shoulder adjacent to a lower edge of the extension to contact a lower edge of the dampener.

7. The device of claim 1, further comprising a rib extending from a back edge of the extension to the developer housing.

8. The device of claim 1, further comprising a flap seal positioned between the dampener and the doctor blade.

9. The device of claim 1, further comprising a flap seal positioned between the dampener and the extension.

10. A device to support a doctor blade within an image forming apparatus comprising:

a developer housing having a first edge and a second edge positioned a distance apart to position the doctor blade;

a support extending between the first edge and the second edge; and a first extension and a second extension each extending from the support and equally distanced from a centerline of the developer housing.

11. The device of claim 10, wherein the first and second extensions have equally sized contact surfaces that contact the doctor blade.

12. The device of claim 11, wherein the contact surfaces are substantially rectangular in shape.

13. The device of claim 10, further comprising dampeners positioned on the first and second extensions to contact the doctor blade, the dampeners being constructed of a resilient material.

14. An image forming apparatus comprising:

a developer roller;

a doctor blade having a top edge and a bottom edge, the bottom edge contacting the developer roller;

a biasing member contacting the top edge of the doctor blade to bias the doctor blade against the developer roller;

a first member and a second member each positioned to contact a front side of the doctor blade;

a first extension and a second extension each positioned on a back side of the doctor blade; and a first dampener positioned on the first extension and a second dampener positioned on the second extension, the front side of the doctor blade contacts the first and second members and the back side of the doctor blade contacts the first and second dampeners.

15. The apparatus of claim 14, each of the first and second dampeners being of a resilient material and being in a compressed state.

16. A retainer to position a doctor blade against a developer roller within an image forming apparatus, said retainer comprising:

a front retention member positioned adjacent to a front side of the doctor blade;

a top retention member positioned on a top edge of the doctor blade;

an extension positioned on a back side of the doctor blade; and a dampener constructed of a resilient material and being in a compressed state positioned between the extension and the doctor blade.

17. The retainer of claim 16, wherein the front side of the doctor blade contacts the front retention member and the back side of the doctor blade contacts the dampener.

18. A method of dampening a doctor blade within an image forming apparatus comprising the steps of:

rotating a developer roller;

applying a first force to a doctor blade to contact a bottom edge of the doctor blade against the developer roller;

dampening the motion of the doctor blade perpendicular to the first force by positioning a dampening material against the doctor blade.

19. The method of claim 18, further comprising compressing the dampening material against the doctor blade.

* * * * *